US007071630B1

(12) United States Patent
York

(10) Patent No.: US 7,071,630 B1
(45) Date of Patent: Jul. 4, 2006

(54) CLOSED LOOP MAGNETIC BOOST LED DRIVER SYSTEM AND METHOD

(75) Inventor: Truc Linh York, Sunnyvale, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 11/211,132

(22) Filed: Aug. 24, 2005

Related U.S. Application Data

(63) Continuation-in-part of application No. 10/720,953, filed on Nov. 24, 2003, now Pat. No. 6,943,504.

(51) Int. Cl.
*H05B 37/02* (2006.01)
*H05B 41/24* (2006.01)

(52) U.S. Cl. ..... 315/224; 315/247; 315/291; 323/288

(58) Field of Classification Search ..... 315/224, 315/247, 209 R; 323/288; 363/21.01
See application file for complete search history.

(56) References Cited

U.S. PATENT DOCUMENTS 6,577,512 B1 * 6/2003 Tripathi et al. ..... 363/21.17
6,586,890 B1 * 7/2003 Min et al. ..... 315/224
6,760,238 B1 * 7/2004 Charych ..... 363/97
2002/0125872 A1 * 9/2002 Groom et al. ..... 323/288
2006/0055389 A1 * 3/2006 Rice ..... 323/288

* cited by examiner

*Primary Examiner*—Trinh Vo Dinh
(74) *Attorney, Agent, or Firm*—Brett A. Hertzberg; Merchant & Gould PC

(57) ABSTRACT

Current is delivered to a load using a closed-loop boost circuit topology that is suitable for LED driver applications. An inductor is charged when a transistor is active during a first operating phase. The inductor delivers current to the load when the transistor is inactive during a second operating phase. A ramp circuit is enabled by at least a feed-forward circuit that detects when the inductor enters the charging cycle. The charging time of the inductor is controlled by a comparator that selectively disables the transistor in response to a ramp voltage and an error voltage. The slope of the ramp is adjusted in response to the error voltage, which is adjusted by an error amplifier that is responsive to the current in the load. The value associated with the inductor can be relatively small, and the boost circuit is arranged to operate over a wide range of operating frequencies.

20 Claims, 13 Drawing Sheets

CLOSED LOOP MAGNETIC BOOST LED DRIVER SYSTEM AND METHOD

RELATED APPLICATION

This patent application is a continuation-in-part of U.S. patent application Ser. No. 10/720,953, now U.S. Pat. No. 6,943,504 which was filed Nov. 24, 2003, and claims the benefit under 35 U.S.C. 120 of the filing date.

FIELD OF THE INVENTION

The present invention relates to a system and method for controlling the current delivered to a load. More particularly, the load current is delivered by an inductor that is controlled using a closed-loop boost circuit topology that is suitable for use in LED driver applications. With the described topology, the value associated with the inductor is relatively small and the boost circuit operates over a wide operating frequency range.

BACKGROUND OF THE INVENTION

Demand for portable electronic devices is increasing each year. Example portable electronic devices include: laptop computers, personal data assistants (PDAs), cellular telephones, and electronic pagers. Portable electronic devices place high importance on total weight, size, and battery life for the devices. Many portable electronic devices employ rechargeable batteries such as Nickel-Cadmium (NiCad), Nickel-Metal-Hydride (NiMHi), Lithium-Ion (Li-Ion), and Lithium-Polymer based technologies.

In many portable power applications, a voltage that exceeds the battery voltage is required to operate certain circuits such as a video display. DC—DC converters are switching-type regulators that can be used to generate higher output voltages from a battery voltage. The output voltage is typically provided to a load circuit by varying the conduction time that is associated with a controlled device. Example controlled devices include transistors, gate-turn-on (GTO devices), thyristors, diodes, as well as others The frequency, duty cycle, and conduction time of the controlled device is varied to adjust the average output voltage to the load. Typical DC—DC converters are operated with some sort of oscillator circuit that provides a clock signal. The output voltage of the converter is also determined by the oscillation frequency associated with the clock signal.

For display applications such as stacked light emitting diodes (LEDs), the DC—DC converter often employs a constant frequency current mode control scheme. An example of a conventional closed loop control circuit (100) for driving LEDs is illustrated in FIG. 1. Circuit 100 includes an oscillator, an SR-type latch, an inductor (L1), two transistors (Q1, Q2), a Schottky diode (D1), two capacitors (C1, C2), three resistors ($R_{SET}$, $R_{SNS1}$, $R_{SNS2}$), three amplifiers ($A_1$ –$A_3$), two driver circuits ($DRV_1$, $DRV_2$), a reference circuit (REF), a summer, and the LED stack ($D_2$–$D_5$).

At the start of each cycle of the oscillator, the SR latch is set and transistor $Q_1$ is turned on via driver circuit $DRV_1$. Amplifier $A_3$ produces a sense voltage ($V_{SNS1}$) by sensing the switching current from transistor $Q_1$ via sense resistor $R_{NSN1}$. The signal ($V_{SUM}$) at the non-inverting input of the PWM comparator ($A_2$) is determined by the switch current via $V_{SNS1}$, summed together with a portion of the oscillation ramp signal. Amplifier $A_1$ is an error amplifier that provides an error signal ($V_{ERR}$) by evaluating the drive current ($I_{LED}$) via transistors $Q_2$ and resistor $R_{SNS2}$. The PWM comparator ($A_2$) resets the SR latch and turns off transistor $Q_1$ when the sum signal ($V_{SUM}$) reaches the level set by the error signal ($V_{ERR}$). Thus, amplifier $A_1$ and driver circuit DRV1 set the peak current level to keep the drive current ($I_{LED}$) in regulation. Resistor $R_{SET}$ is adjusted to change the peak current level via a reference circuit (REF) and amplifier $A_1$.

BRIEF DESCRIPTION OF THE DRAWINGS

Non-limiting and non-exhaustive embodiments of the present invention are described with reference to the following drawings.

DETAILED DESCRIPTION OF THE PREFERRED EMBODIMENT

Figure 1:
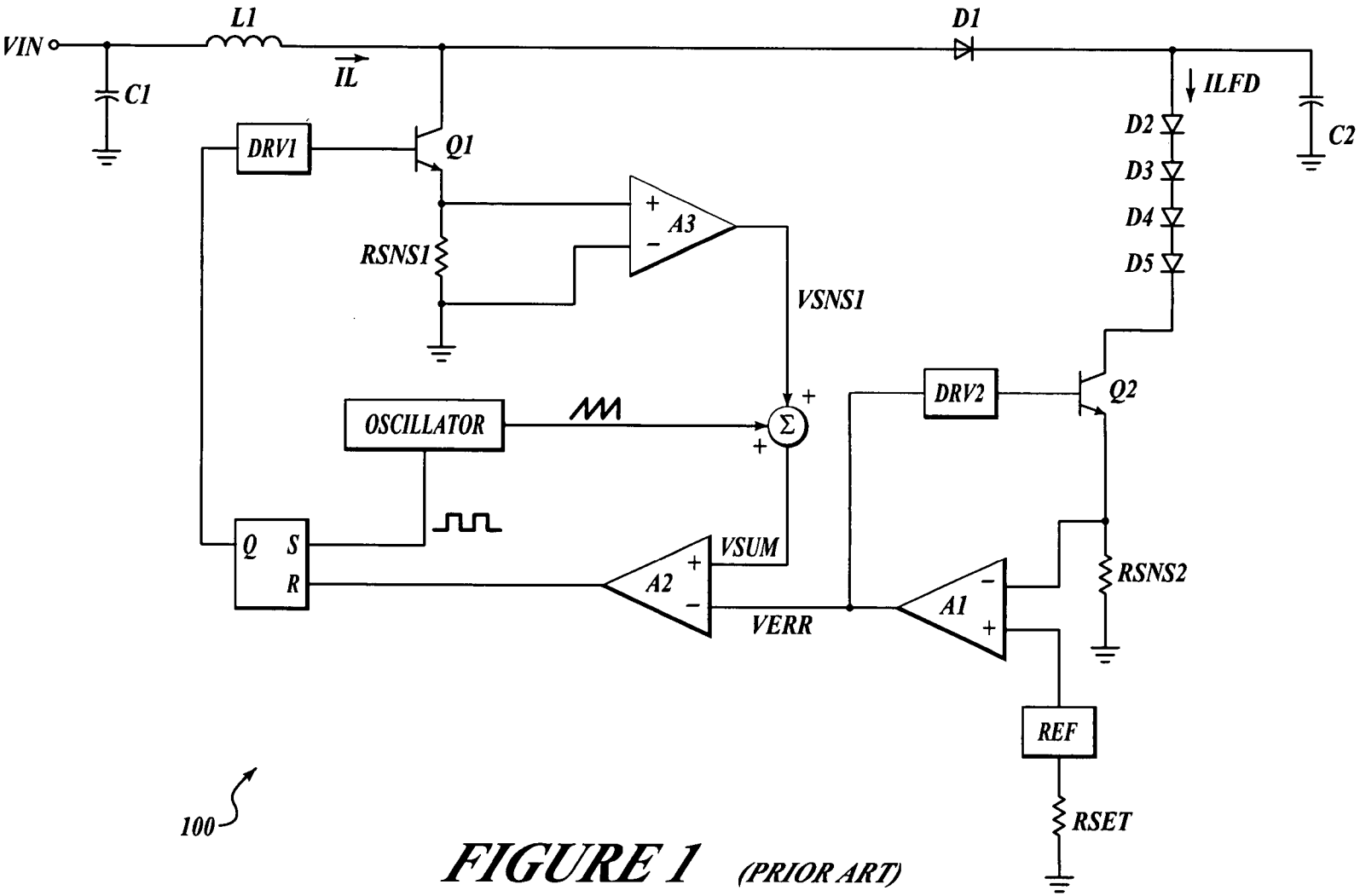
FIGURE 1 (PRIOR ART)
FIG. 1 is an illustration of a conventional DC—DC converter.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context clearly dictates otherwise. The meanings identified below are not intended to limit the terms, but merely provide illustrative examples for the terms. The meaning of "a," "an," and "the" includes plural reference, the meaning of "in" includes "in" and "on." The term "connected" means a direct electrical connection between the items connected, without any intermediate devices. The term "coupled" means either a direct electrical connection between the items connected or an indirect connection through one or more passive or active intermediary devices. The term "circuit" means either a single component or a multiplicity of components, either active and/or passive, that are coupled together to provide a desired function. The term "signal" means at least one current, voltage, charge, temperature, data, or other signal.

Briefly stated, the present disclosure is related to an apparatus, system and method for controlling the current delivered to a load. Current is delivered to the load using a closed-loop boost circuit topology that is suitable for LED driver applications. An inductor in the circuit is charged when a transistor is active during a first operating phase. The inductor delivers current to the load when the transistor is inactive during a second operating phase. A ramp circuit is enabled by at least a feed-forward circuit that detects when the inductor enters the charging cycle. The charging time of the inductor is controlled by a comparator that selectively disables the transistor in response to a ramp voltage and an error voltage. The slope of the ramp is adjusted in response to the error voltage, which is adjusted by an error amplifier that is responsive to the current in the load. The value associated with the inductor can be relatively small, and the boost circuit is arranged to operate over a wide range of operating frequencies.

Open-Loop Boost Circuit

Figure 2:
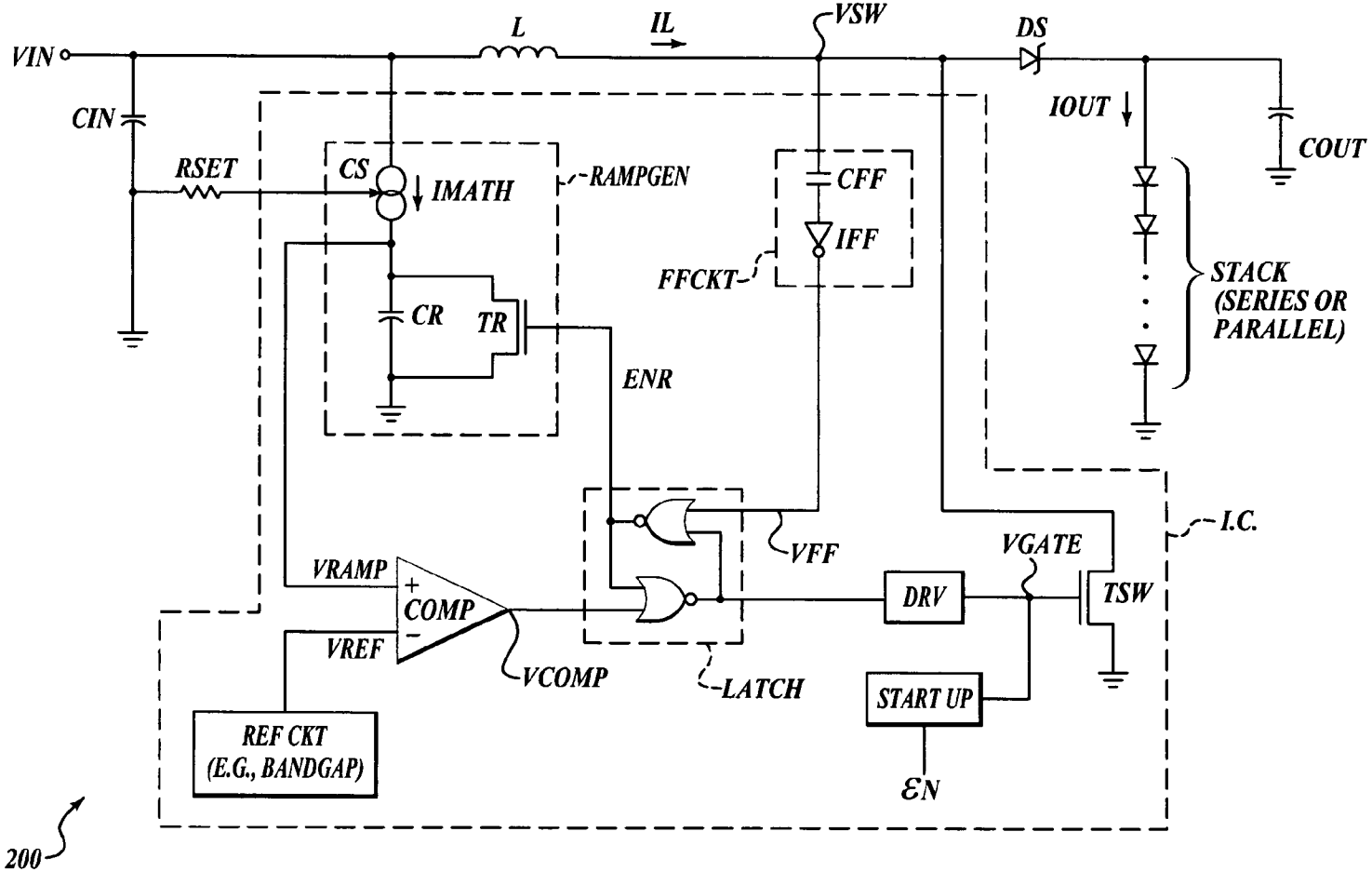
FIG. 2 is an illustration of an example open-loop boost circuit.

FIG. 2 is an illustration of an example open-loop boost circuit (200) that is arranged in accordance with an embodiment of the present disclosure. The open-loop boost circuit (200) includes: two capacitors ($C_{IN}$, $C_{OUT}$), an inductor (L), a stack circuit ($D_1, D_2, \ldots, D_N$), a Schottky-type diode ($D_S$), a feed-forward circuit (FFCKT), a latch circuit (LATCH), a ramp generator circuit (RAMPGEN), a resistor ($R_{SET}$), a comparator (COMP), a reference circuit (REF CKT), a transistor switch circuit ($T_{SW}$), a driver circuit (DRV), and a start-up circuit (STARTUP).

Capacitor $C_{IN}$ is coupled between the input voltage ($V_{IN}$) and ground. Resistor $R_{SET}$ is coupled between the RAMPGEN and ground. RAMPGEN is arranged to provide a ramp voltage ($V_{RAMP}$) with a known slope when enabled. Ramp voltage $V_{RAMP}$ corresponds to ground when RAMPGEN is disabled via signal RES. REF CKT is arranged to provide a voltage reference ($V_{REF}$). Inductor L is selectively coupled to ground through transistor switch circuit $T_{SW}$ when transistor switch circuit $T_{SW}$ is active, and coupled to the stack circuit through Schottky diode $D_S$ when transistor switch circuit $T_{SW}$ is inactive. The stack circuit is coupled between Schottky diode $D_S$ and ground. Capacitor $C_{OUT}$ is coupled in parallel with the stack circuit to minimize ripple in the output voltage ($V_{OUT}$). Feed-forward circuit FFCKT is arranged to sense the voltage ($V_{SW}$) associated with the non-input side of inductor L and provides a signal to an input of latch circuit LATCH. Comparator COMP is arranged to compare ramp voltage $V_{RAMP}$ to reference voltage $V_{REF}$ and provide a comparison signal ($V_{COMP}$) to another input of latch circuit LATCH. One output of latch circuit LATCH is arranged to provide signal RES. Another output of latch circuit LATCH is arranged to selectively activate transistor switch circuit $T_{SW}$ via driver circuit DRV and signal $V_{GATE}$. Start up circuit START UP is arranged to force signal $V_{GATE}$ during a start-up sequence (when EN is active) such that inductor L is charged and the latch is initialized to an appropriate condition via comparator COMP and the feed-forward circuit.

An example feed-forward circuit includes a capacitor ($C_{FF}$) and an inverter circuit (IFF), which are coupled between signal $V_{SW}$ and an input of the latch circuit. Changes in the signal $V_{SW}$ are detected by the capacitor and fed to the latch circuit as signal $V_{FF}$. For example, $V_{FF}$ corresponds to a low logic level until $V_{SW}$ drops below a threshold associated with inverter circuit IFF, where $V_{FF}$ pulses as a high logic pulse.

Latch circuit LATCH is illustrated as two NOR logic gates that are coupled together as shown in FIG. 2. However, other latch circuits are within the scope of the present disclosure including NAND gate implementations, and other logic configurations that provide a similar function.

Ramp generator RAMPGEN is illustrated as a current source (CS) that has an output coupled to a capacitor ($C_R$), and an input that is coupled to resistor $R_{SET}$. Transistor switching circuit $T_{SW}$ is configured to short capacitor ($C_R$) to ground when signal RES is active such that the ramp is reset to a known value before each ramp cycle begins. Current source CS provides a current ($I_{MATH}$) to capacitor $C_R$ such that the capacitor charges at a constant rate. The charging rate is adjusted by changing the magnitude of current $I_{MATH}$, which is adjusted by resistor $R_{SET}$.

The output current ($I_{OUT}$) is adjusted by changing a value associated with resistor $R_{SET}$, which in turn adjusts the slope of ramp voltage $V_{RAMP}$. The slope of ramp voltage $V_{RAMP}$ controls the on-time ($T_{ON}$) associated with transistor switch circuit $T_{SW}$, which in turn controls the charging of inductor L. For example, comparator COMP controls the gate voltage ($V_{GATE}$) via driver circuit DRV and latch circuit LATCH such that transistor switching circuit $T_{SW}$ is disabled when the ramp voltage ($V_{RAMP}$) exceeds the reference voltage ($V_{REF}$).

Circuit 200 is arranged to operate as an open-loop driver circuit that operates on the edge of constant-current mode (CCM) and discontinuous-current mode (DCM). The output current ($I_{OUT}$) is provided to a load such as a stack of LEDs as illustrated in FIG. 2. The load may also be a parallel combination of LEDs, a different series combination of LEDs, or some other device or devices that have a predictable voltage when driven with a known current. The overall topology can be implemented as an integrated circuit (IC) that has characteristics such as: minimal die size, high efficiency, high operating frequency, low operating current, and very low values (e.g., 1 uH) of inductance for L.

Figure 3A:
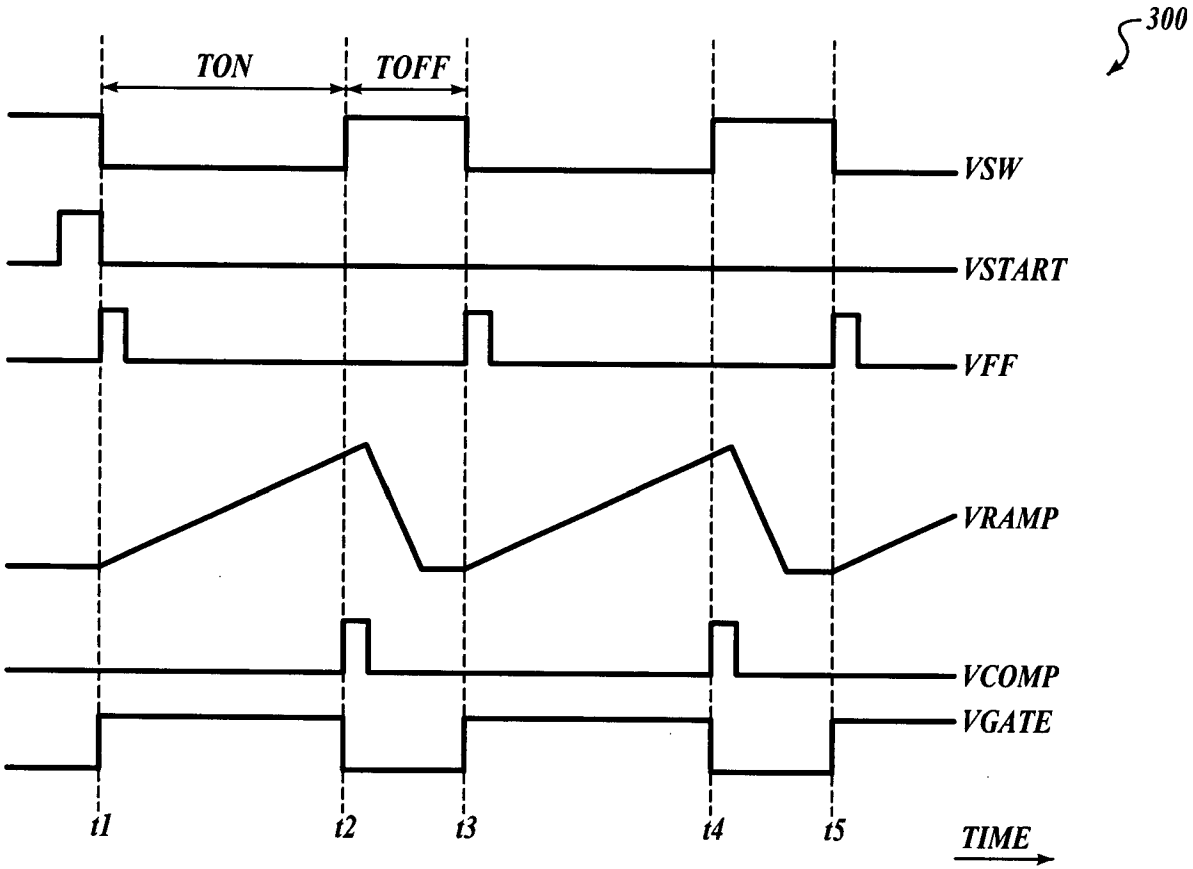
FIG. 3A is an illustration of example signal waveforms for the circuit illustrated in FIG. 2.
Figure 3B:
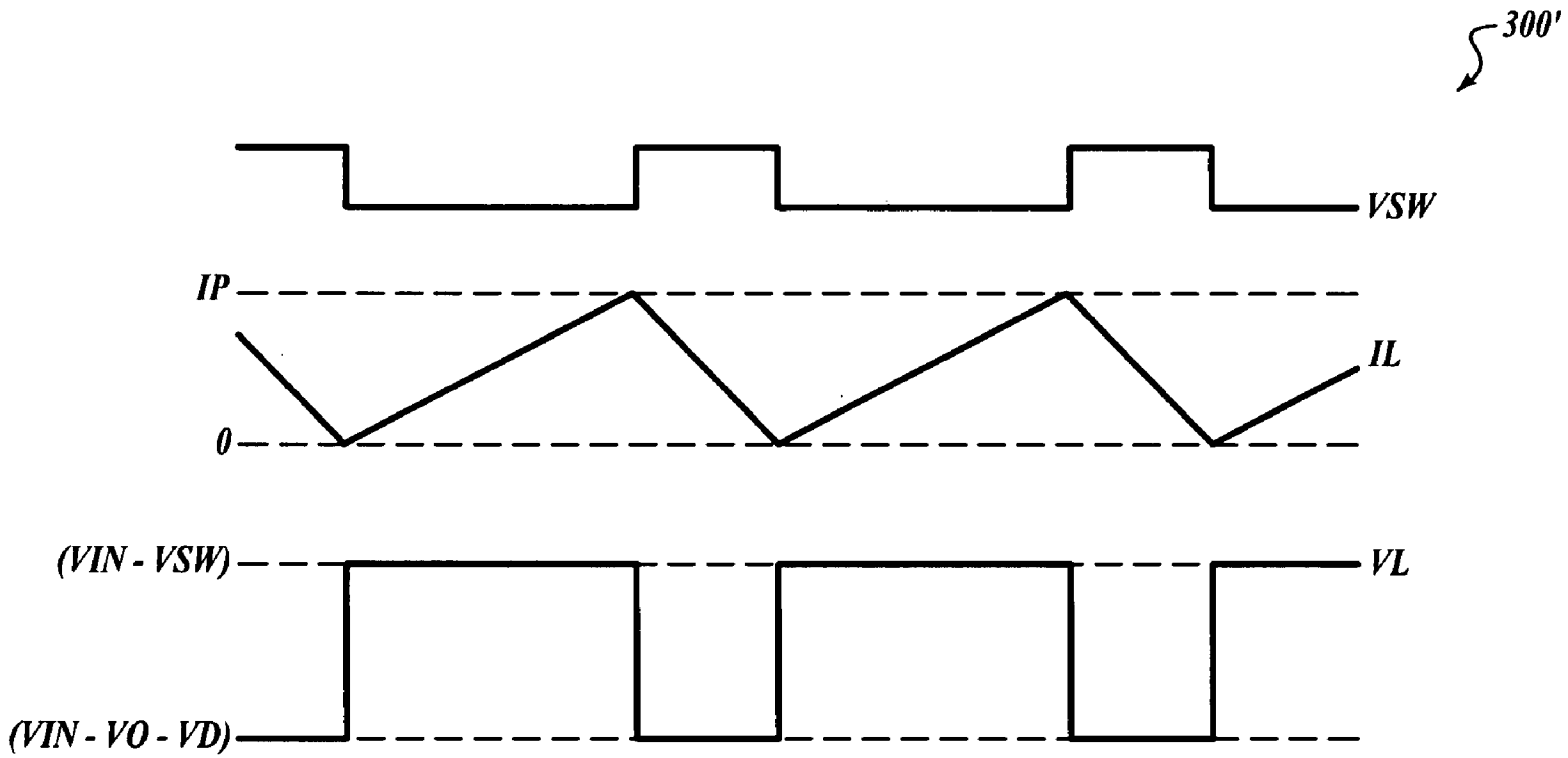
FIG. 3B is an illustration of additional example signal waveforms for the circuit illustrated in FIG. 2.

FIG. 3A and FIG. 3B are illustrations of example signal waveforms for the circuit illustrated in FIG. 2. As illustrated in the figures, the inductor is charged during the on-time interval ($T_{ON}$) and discharged to the load during the off-time interval ($T_{OFF}$). The on-time interval is active from time $t_1$ through $t_2$, while the off-time interval is active from time $t_2$ through $t_3$. The cycle repeats again as illustrated by times $t_3$ through $t_5$.

From times $t_1$ through $t_2$, transistor switching circuit $T_{SW}$ is activate and signal RES corresponds to a low logic level such that the ramp generator (RAMPGEN) is enabled. The switch voltage ($V_{SW}$) is approximately the same as the ground voltage (e.g., 0V or $V_{SS}$) depending on the $rds_{ON}$ of transistor $T_{SW}$. The voltage ($V_L$) across inductor L corresponds to $V_L=V_{IN}-V_{SW}$ and inductor L is charged as illustrated by inductor current $I_L$. The ramp voltage ($V_{RAMP}$) increases while signal RES is active. The rate of ramp voltage $V_{RAMP}$ is determined by the charging current ($I_{MATH}$) and the value associated with capacitor $C_R$.

The output of comparator COMP corresponds to a low logic level while ramp voltage $V_{RAMP}$ is below reference voltage $V_{REF}$. At time $t_2$ (and $t_4$), ramp voltage $V_{RAMP}$ exceeds reference voltage $V_{REF}$ by an amount sufficient for comparator circuit COMP to change to a high logic level (see $V_{COMP}$). The latch circuit is responsive to VCOMP such that transistor switching circuit $T_{SW}$ is deactivated when $V_{COMP}$ corresponds to a high logic level signal (e.g., see $V_{GATE}$). The inductor current ($I_L$) reaches a peak value ($I_P$) when transistor switching circuit $T_{SW}$ is deactivated around time $t_2$.

From time $t_2$ through $t_3$ ($T_{OFF}$) transistor switching circuit $T_{SW}$ remains deactivated by the high logic level from the comparator such that the current in the inductor is delivered to the load (e.g., the LED stack). Inductor current ($I_L$) continues to flow to the load via diode $D_S$ until the time $t_3$. At time $t_3$, the inductor current ($I_L$) drops to a current level that is insufficient to forward bias diode $D_S$(IL≈0) and the switch voltage ($V_{SW}$) begins to drop. The feed-forward circuit senses the drop in the switch voltage ($V_{SW}$) and generates a pulsed signal ($V_{FF}$) that sets signal RES to a high logic level. After signal RES pulses high, the ramp generator is reset (e.g., $V_{RAMP}$=0V), the output of the comparator is set to a low logic level, and transistor switching circuit $T_{SW}$ is activated. The cycle repeats from time $t_3$ through $t_4$ as recited previously with respect to times $t_1$ through $t_2$. The circuit operation from times $t_4$ through $t_5$ operate substantially the same as that described with reference to times $t_2$ through $t_3$.

The on-time interval ($T_{ON}$) for transistor switching circuit $T_{SW}$ is determined by the reference voltage level ($V_{REF}$) and the rate of the voltage ramp ($V_{RAMP}$). For the example ramp circuit illustrated in FIG. 2, the on-time interval ($T_{ON}$) is determined by:

$$T_{ON}=C_R*V_{REF}/I_{MATH} \quad \text{(Eq. 1)}$$

The current source (CS) is arranged such that current $I_{MATH}$ is related to the square of the input voltage ($V_{IN}$) and the value associated with resistor $R_{SET}$ as:

$$I_{MATH}=R_{SET}*V_{IN}^2/(V_{REF}2*R^2) \quad \text{(Eq. 2)}$$

where $V_{RSET}$ is another reference voltage and R is another resistor in the current source circuit (CS).

Substituting equation 2 into equation 1 yields:

$$T_{ON}=C_R*V_{REF}/(R_{SET}*V_{IN}^2/(V_{RSET}*R^2))$$

$$T_{ON}=C_R*V_{REF}*V_{RSET}*R^2/(R_{SET}*V_{IN}^2)$$

$$T_{ON}=K/V_{IN}^2, \quad \text{(Eq. 3)}$$

where K is a constant given by $K=V_{REF}*V_{RSET}*R^2/R_{SET}$.

The efficiency (eff) of the circuit is determined by the ratio of the output power ($P_{OUT}$) to the input power ($P_{IN}$) as, where the output power ($P_{OUT}$) is given by:

$$P_{OUT}=eff*P_{IN} \quad \text{(Eq. 4)}$$

The output power ($P_{OUT}$) is related to the average output current ($I_{OUTAV}$) and the output voltage ($V_{OUT}$) as $P_{OUT}=V_{OUT}*I_{OUTAV}$, while the input power ($P_{IN}$) is similarly related to the average input current ($I_{INAV}$) and the input voltage ($V_{IN}$) as $P_{IN}=V_{IN}*I_{INAV}$. Substituting into equation 4 yields:

$$V_{OUT}*I_{OUTAV}=eff*V_{IN}*I_{INAV} \quad \text{(Eq. 5)}$$

Solving for the average output current ($I_{OUT}$) yields:

$$I_{OUTAV}=eff*V_{IN}*I_{INAV}/V_{OUT} \quad \text{(Eq. 6)}$$

The inductor current ($I_L$) is related to the inductor voltage ($V_L$) as:

$$dI_L(t)/dt=V_L(t)/L \quad \text{(Eq. 7)}$$

Since the current peaks at a value of $I_P$ over the time interval $T_{ON}$, equation 7 can be represented as:

$$I_P/T_{ON}=V_{IN}/L \quad \text{(Eq. 8)}$$

Solving equation 8 for the peak current yields:

$$I_P=V_{IN}*T_{ON}/L \quad \text{(Eq. 9)}$$

The average value of the input current corresponds to half of the peak current such that:

$$I_{INAV}=I_P/2$$

$$I_{INAV}=V_{IN}*T_{ON}/(2*L) \quad \text{(Eq. 10)}$$

Substituting equation 10 into equation 6 yields:

$$I_{OUTAV}=eff*V_{IN}*(V_{IN}*T_{ON}/(2*L))/V_{OUT}$$

$$I_{OUTAV}=eff*V_{IN}^2*T_{ON}/(2*L*V_{OUT}) \quad \text{(Eq. 11)}$$

Substituting equation 3 into equation 11 yields:

$$I_{OUTAV}=eff*V_{IN}^2*(K/V_{IN}^2)/(2*L*V_{OUT})$$

$$I_{OUTAV}=eff*K/(2*L*V_{OUT}) \quad \text{(Eq. 12)}$$

As observed in the equations listed above, the output current ($I_{OUT}$) is independent of the input voltage ($V_{IN}$). Instead, the output current is inversely proportional to the value of the inductor (L) and a series of constants. The current source circuit (CS) is arranged such that the on-time is adjusted via resistor $R_{SET}$ in such as way that the output current ($I_{OUT}$) is inversely proportional to the value associated with $R_{SET}$. In one example, current source CS described above is arranged to provide a current that is proportional to $R_{SET}*V_{IN}^2$.

Figure 4:
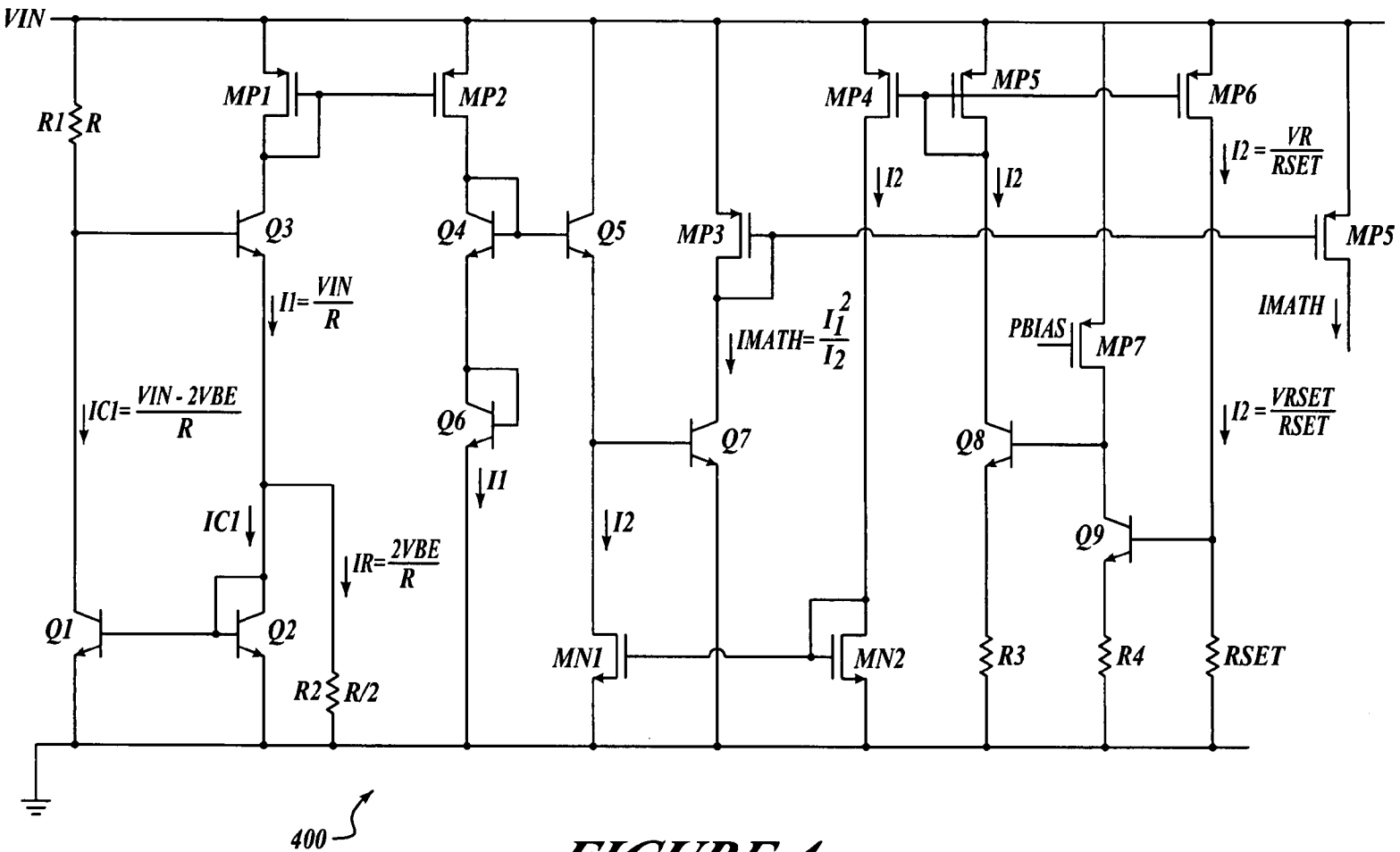
FIG. 4 is an illustration of an example current adjustment circuit for the circuit illustrated in FIG. 2.

FIG. 4 is an illustration of an example current adjustment circuit for the circuit illustrated in FIG. 2. $R_{SET}$ is included in FIG. 2 for reference. The example current adjustment circuit is arranged to provide an output current ($I_{MATH}$) that is proportional to $R_{SET}*V_{IN}^2$.

Transistors $Q_2$ and $Q_3$ are arranged to provide a voltage across resistor $R_1$ to set the collector current ($I_{C1}$) of transistor $Q_1$ as: $I_{C1}=(V_{IN}-2V_{BE})/R$, where resistor $R_1$ has a value corresponds to R. Transistors $Q_1$ and $Q_2$ are arranged in a current mirror configuration such that they have substantially the same collector current. Resistor $R_2$ has a value corresponding to R/2, and is arranged in parallel with transistor $Q_2$ such that the current through resistor $R_2$ corresponds to $I_{R2}=2V_{BE}/R$. The resulting collector current ($I_{C3}$) through transistor $Q_3$ corresponds to $V_{IN}/R$.

Transistors $M_{P1}$ and $M_{P2}$ are arranged in a current mirror configuration such that their drain currents are ratio matched ($X*I_{D1}=I_{D2}$), where drain current $I_{D1}$ is given by $I_{D1}=I_Q=V_{IN}/R$. Transistors $Q_4$ and $Q_6$ are arranged to operate as diodes that are biased by current $I_{D2}=X*V_{IN}/R$.

Transistor $M_{P7}$ is biased to operate as a current source from another circuit (not shown) such as a band-gap reference, and provide current to the collector of transistor $Q_9$. Transistors $Q_9$ generates a reference voltage ($V_{RSET}$) that corresponds to $V_{BE9}+I_{D7}*R_4$. Transistor $Q_8$ and resistor $R_3$ are arranged to sense the collector voltage of transistor $Q_9$ to generate current $I_2$. Transistor $M_{P5}$ and $M_{P6}$ are arranged in a current mirror configuration such that their drain currents are ratio matched ($I_{D5}=Y*I_{D6}$). Transistor $M_{P5}$ senses the collector current ($I_{C8}$) from transistor $Q_8$ and reflects the current to resistor $R_{SET}$ via transistor $M_{P6}$. The resulting current for current I2 corresponds to $V_{RSET}/R_{SET}$.

Transistors $M_{P4}$ and $M_{P5}$ are arranged in a current mirror configuration such that their drain currents are ratio matched ($I_{D4}=Z*I_{D5}$). Transistors $M_{N1}$ and $M_{N2}$ are also arranged in a current mirror configuration such that their drain currents are ratio matched ($I_{D1}=A*I_{D2}$). Transistors $M_{P4}$, $M_{N2}$, and $M_{N1}$ are arranged to reflect current proportional to $I_2$ to the drain of transistor $M_{N1}$. The drain of transistor $M_{N1}$ is coupled to the emitter of transistor $Q_5$ and the base of transistor $Q_7$. Since transistor $Q_5$ has a collector current of $I_1$ and transistor $M_{N1}$ has a drain current of $I_2$, the base current to transistor $Q_7$ corresponds to $(I_1-I_2)$, resulting in a collector current for transistor $Q_7$ that is proportional to $I_1^2/I_2$. Transistors $M_{P3}$ and $M_{PS}$ are arranged in a current mirror configuration such that their drain currents are ratio matched ($I_{D3}=B*I_{DS}$). The resulting current at the drain of transistor $M_{PS}$ corresponds to $I_{MATH}=I_1^2/I_2$. Since $I_1$ is proportional to $V_{IN}/R$, and $I_2$ is proportional to $V_{RSET}/R_{SET}$, then $I_{MATH}$ is proportional to the ratio: $(V_{IN}/R)^2/(V_{RSET}/R_{SET})$ or $(R_{SET}*V_{IN}^2/(V_{RSET}*R^2))$.

Figure 5:
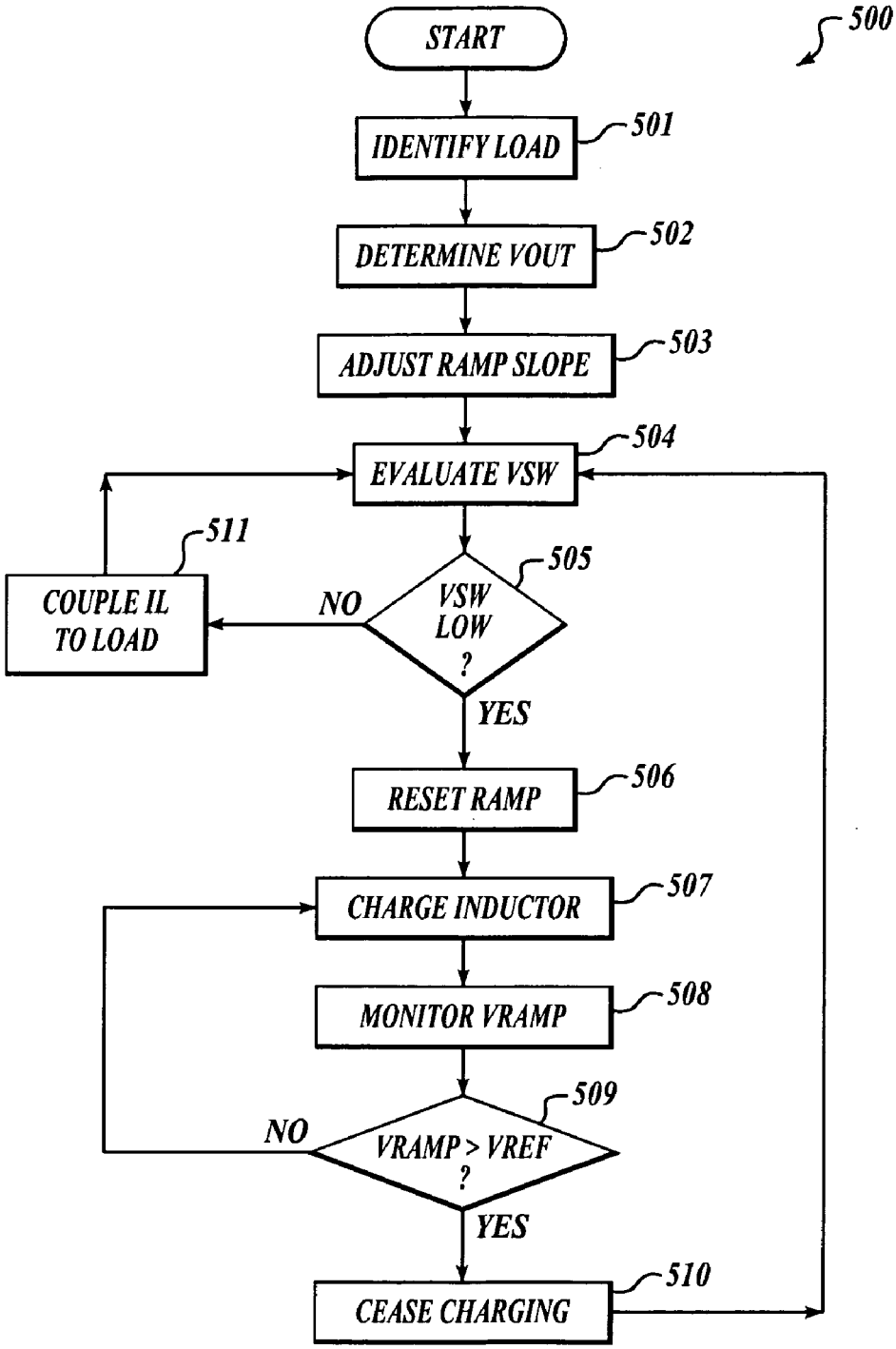
FIG. 5 is an illustration of an example procedural flow for an open-loop boost circuit.

FIG. 5 is an illustration of an example procedural flow for an open-loop boost circuit that is arranged in accordance with the present disclosure. At block 501, a load is identified. In one example, the load corresponds to a number of LEDs for operation as stacked diodes (e.g., see FIG. 2). Continuing to block 502, the output voltage requirements are determined from the identified load (e.g., the operating voltage for the stacked devices). Proceeding to block 503, the slope of the ramp is adjusted (e.g., changing a value associated with resistor RSET) based on the identified load's output current and voltage requirements.

Operation of the driver circuit begins at block 503, where the output driver current is automatically changed (e.g., automatically adjusting a current source) based on the selected ramp. Continuing to block 504 the switch voltage is evaluated by the circuit. Processing continues from block 504 to decision block 505. The process flows from decision block 505 to block 511 when the switch voltage ($V_{SW}$) is evaluated as high indicating that the switching circuit is in the $T_{OFF}$ interval. At block 511, current from the inductor ($I_L$) is delivered to the load circuit (e.g., $T_{SW}$ is deactivated and $I_L$ couples through $D_S$ to the load). Alternatively, processing flows from decision block 505 to block 506 when the switch voltage ($V_{SW}$) is evaluated as low indicating that the switching circuit is in the $T_{ON}$ interval.

The ramp is reset at block 506 such that a ramp voltage ($V_{RAMP}$) is initialized to a predetermined level (e.g., one of the power supply voltages, ground, etc). Continuing to block 507, the inductor is charged (e.g., $T_{SW}$ is active and the inductor charges with $V_{IN}$). At block 508 the ramp voltage is monitored. Processing continues from decision block 509 to block 510 when the ramp voltage ($V_{RAMP}$) exceeds a reference voltage ($V_{REF}$). Alternatively, processing continues from decision block 509 to block 507 when the ramp voltage ($V_{RAMP}$) has not exceeded the reference voltage ($V_{REF}$).

At decision block 509, the process evaluates the ramp enable signal. Processing continues from decision block 509 to block 510, where the inductor is charged while the ramp is enabled. Alternatively, processing continues from decision block 509 to block 511, where the charging of the inductor is terminated when the ramp is detected as disabled. Processing continues from block 510 to block 507, where the ramp voltage is continually monitored until the ramp reaches $V_{REF}$(where $T_{ON}$ is terminated). Processing flows from block 511 to block 504 where the next cycle begins.

Closed-Loop Boost Circuit

Figure 6:
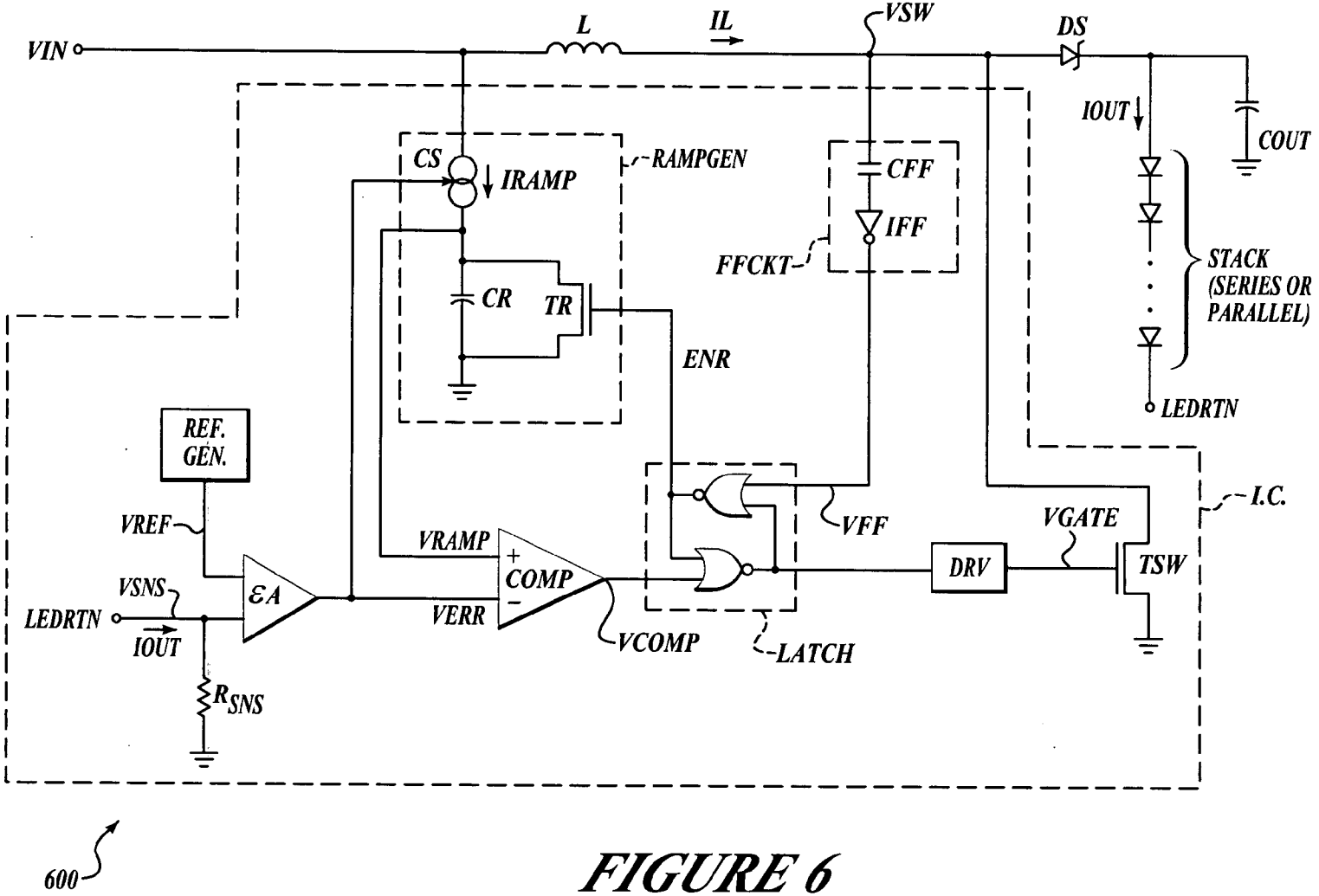
FIG. 6 is an illustration of an example closed-loop boost circuit.

FIG. 6 is an illustration of an example closed-loop boost circuit (600) that is arranged in accordance with an embodiment of the present disclosure. The closed-loop boost circuit (200) is arranged similar to that described previously with respect to FIG. 2, with similar components labeled identically. Differing from FIG. 2, FIG. 6 further includes an error amplifier circuit (EA), a sense resistor ($R_{SNS}$) and a reference circuit (REF GEN). Also, FIG. 6 does not illustrate a startup circuit, a power switch current limit ($I_{LIMIT}$) circuit or an over-voltage circuit, but they all can be added as will be described further with respect to FIGS. 8 and 10.

Closed-loop boost circuit 600 is arranged to provide feedback between the output load (e.g., a series and/or parallel combination of LEDs), and the error amplifier. Thus, differing from FIG. 2, circuit 600 illustrates that the load circuit is coupled to a signal ground (e.g., VSS, GND, etc.) via resistor $R_{SNS}$. The reference circuit (REF GEN) is arranged to provide a reference voltage ($V_{REF}$) that is coupled to one input of the error amplifier (EA). The voltage across resistor $R_{SNS}$(e.g., $V_{SNS}$) is coupled to the other input of the error amplifier (EA). The output of the error amplifier (e.g., $V_{ERR}$) is coupled to one terminal (e.g., −) of the comparator (COMP) and to the control terminal of the ramp generator circuit (RAMPGEN). The current source (CS) in the ramp generator circuit (RAMPGEN) is responsive to $V_{ERR}$ to adjust the operating current for charging capacitor CR. The output voltage from the ramp generator (e.g., $V_{RAMP}$) is coupled to the other terminal (e.g., +).

During operation, the current ($I_{OUT}$) through the load is converted into a sense voltage ($V_{SNS}$) that is sensed by the error amplifier (EA) forming a closed feedback loop. For example, when the sense voltage ($V_{SNS}$) exceeds the reference voltage ($V_{REF}$) the error voltage ($V_{ERR}$) adjusts the biasing to the ramp generator such that the on-time of the transistor switch circuit ($T_{SW}$) is reduced. Similarly, when the sense voltage ($V_{SNS}$) is below the reference voltage ($V_{REF}$) the error voltage ($V_{ERR}$) adjusts the biasing to the ramp generator such that the on-time of the transistor switch circuit ($T_{SW}$) is increased. These changes in the on-time translate into a frequency change in the circuit.

The described closed-loop architecture forces regulation at the edge of the constant current mode (CCM). The transistor switch circuit ($T_{SW}$) is activated when the current ($I_L$) in the inductor (L) is detected to reach zero by the feed-forward circuit (FFCKT). The inductor (L) is charged while the transistor switch circuit ($T_{SW}$) is active. While the transistor switch circuit ($T_{SW}$) is active, the ramp generator circuit (RAMP GEN) is also active. The transistor switch circuit ($T_{SW}$) remains active until the ramp voltage ($V_{RAMP}$) substantially equals or exceeds the error voltage ($V_{ERR}$) from the error amplifier (EA). At this point, the inductor current ($I_L$) has reached a maximum value, transistor switch circuit ($T_{SW}$) is deactivated, and the inductor current ($I_L$) flows to the load (e.g., the LEDs and output capacitor $C_{OUT}$). The cycle repeats when the inductor current ($I_L$) has again been detected to reach a zero condition.

The on-time of the transistor switch circuit ($T_{SW}$) is controlled by the error amplifier such that the LED current is regulated. The on-time interval ($T_{ON}$) for transistor switching circuit $T_{SW}$ is determined by the reference voltage level ($V_{REF}$) and the rate of the voltage ramp ($V_{RAMP}$). For the example ramp circuit illustrated in FIG. 2, the on-time interval ($T_{ON}$) is determined by:

$$T_{ON}=C_R*V_{ERR}/I_{RAMP} \quad \text{(Eq. 13)}$$

The output voltage ($V_{ERR}$) of the error amplifier (EA) is given by:

$$V_{ERR}\acute{\alpha}A_v*(V_{REF}-I_{OUT}*R_{SNS}) \quad \text{(Eq. 14),}$$

where $A_V$ is the gain of the error amplifier (EA).

The ramp current ($I_{RAMP}$) is also a function of $V_{ERR}$ that depends upon the type of current source employed. For example, the ramp current is related to $V_{ERR}$ according to a square law relationship for a MOS type current source, or perhaps an exponential relationship when a BJT type current source is employed.

The efficiency (eff) of the circuit is determined by the ratio of the output power ($P_{OUT}$) to the input power ($P_{IN}$) as described previously with Eq. 4.

$$P_{OUT}=eff*P_{IN} \quad \text{(Eq. 4)}$$

The resulting average output current ($I_{OUT}$) is also determined by previously described equations 4–11, where equation 11 is:

$$I_{OUT}=(eff*T_{ON}*V_{IN}^2)/(2*L*V_{OUT}) \quad \text{(Eq. 11)}$$

Rearranging Eq. 11 yields:

$$T_{ON}=(2*L*V_{OUT}*I_{OUT})/(eff*V_{IN}^2) \quad \text{(Eq. 15)}$$

The frequency of operation is given by:

$$\text{Freq}=1/T$$

$$\text{Freq}=(V_{OUT}-V_{IN})/(V_{OUT}-*T_{ON}) \quad \text{(Eq. 16)}$$

Substituting Eq. 11 into Eq. 16 yields:

$$\text{Freq}=eff*(V_{OUT}-V_{IN})*V_{IN}^2/(2*L*I_{OUT}*V_{OUT}^2) \quad \text{(Eq. 17)}$$

As observed in the equations listed above, the average of the output current ($I_{OUT}$) is close-loop controlled by error amplifier and the comparator by adjusting the on-time of the switching circuit ($T_{SW}$). The regulated output current is responsive to changes in $V_{IN}$ and $V_{OUT}$ such that an appropriate operating frequency and/or pulse width is achieved (PFM).

Figure 7:
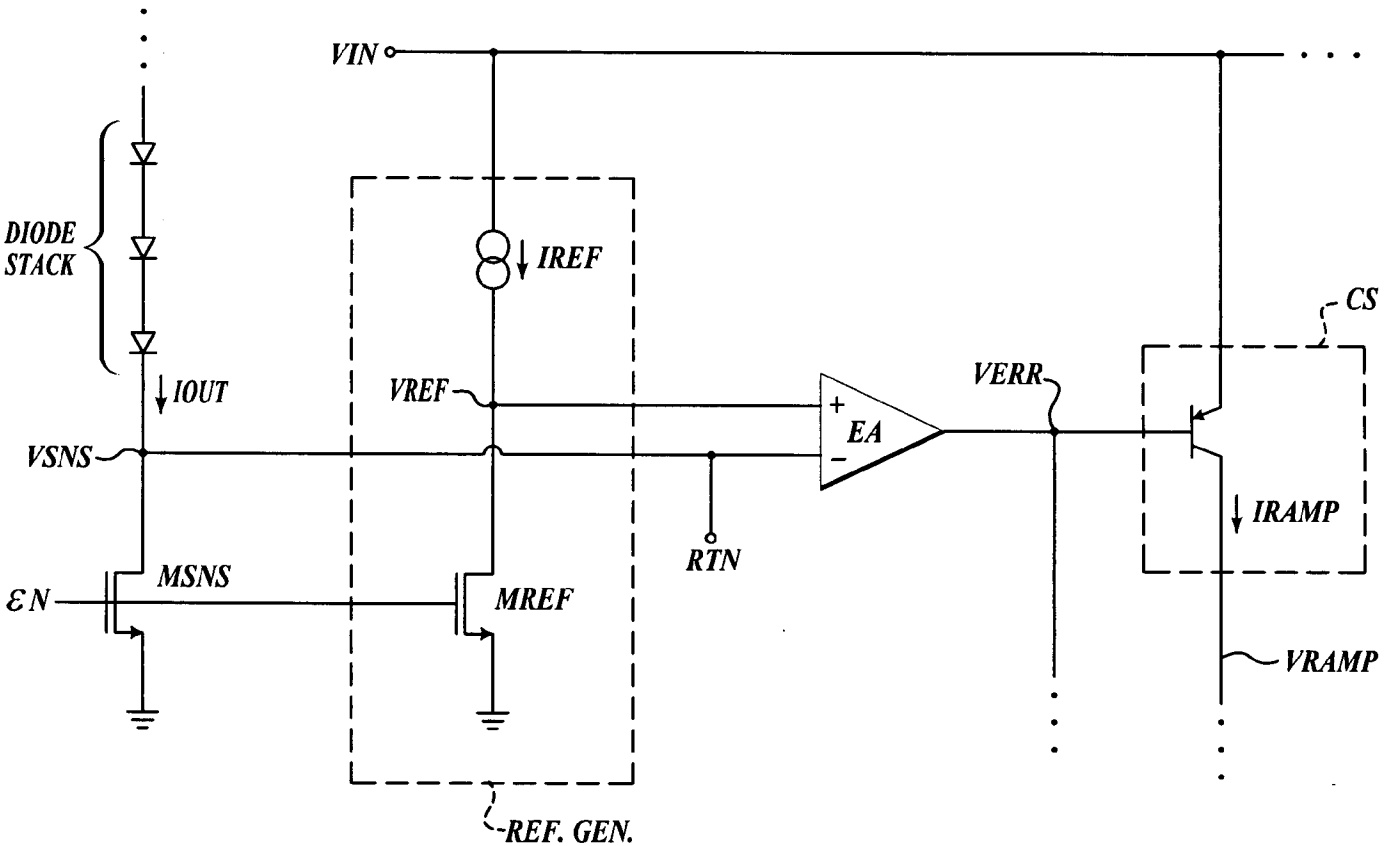
FIG. 7 is an illustration of another example closed-loop boost circuit.
Figure 8:
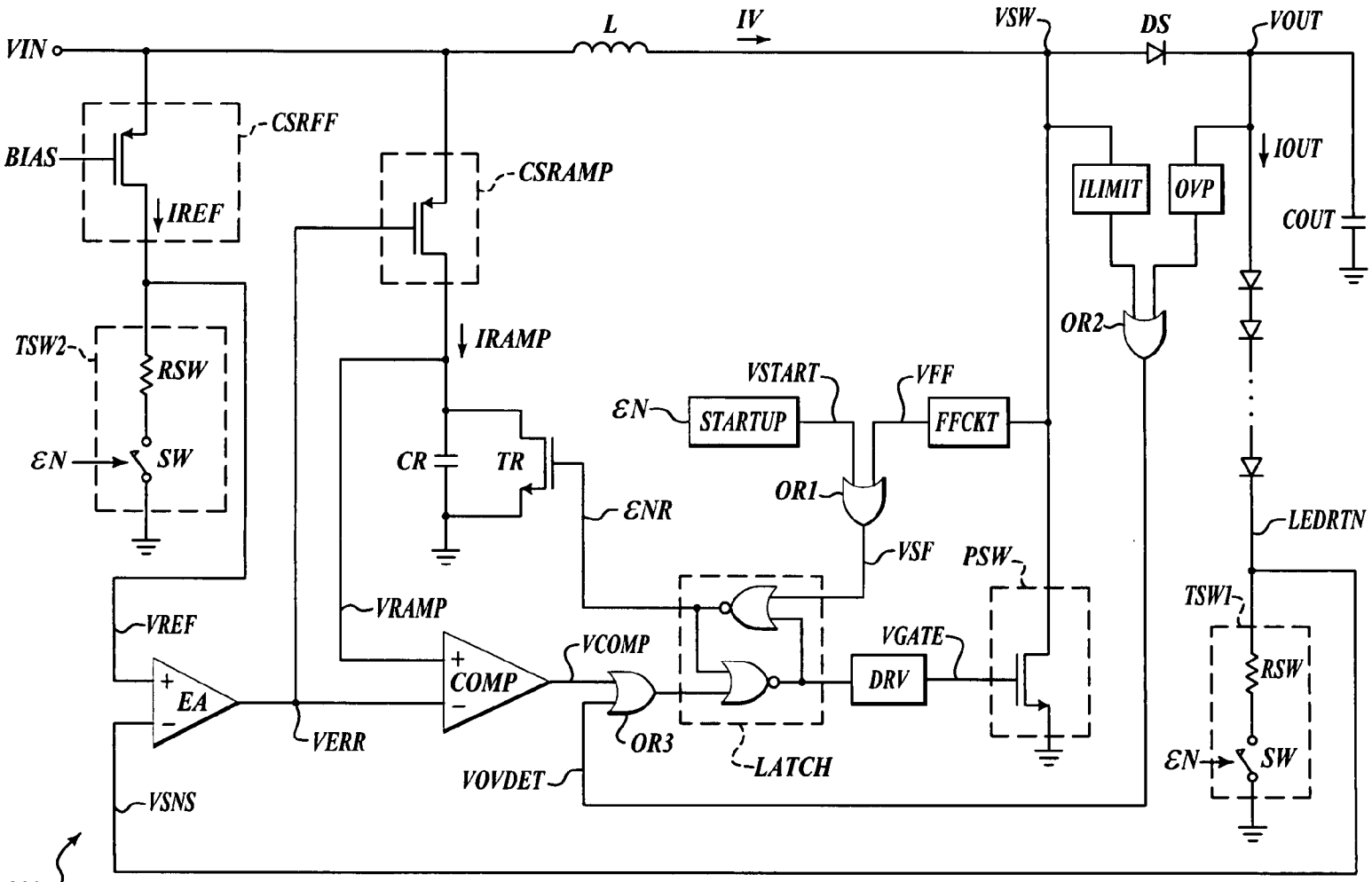
FIG. 8 is an illustration of still another example closed-loop boost circuit.

FIG. 7 is an illustration of another example closed-loop boost circuit (700) that can be used to substitute certain component blocks from FIG. 8. For this example circuit, the sense resistor ($R_{SNS}$) from FIG. 6 has been replaced with a transistor ($M_{SNS}$) that has an inherent on-resistance that is equivalent to $R_{SNS}$. The reference generator (REF GEN) of FIG. 6 is replaced with a current source ($I_{REF}$) and another transistor ($M_{REF}$). The current source (CS) from the ramp generator circuit (RAMP GEN) is replaced with a bipolar junction transistor (BJT).

Similar to that described previously with respect to FIG. 6, transistor $M_{SNS}$ is arranged to generate a sense voltage ($V_{SNS}$) in response to the current ($I_{OUT}$) that is flowing through the load (e.g., the LEDs). The current source couples a current ($I_{REF}$) to transistor $M_{REF}$, which in turn generates a reference voltage ($V_{REF}$). Signals $V_{REF}$ and $V_{SNS}$ are again coupled to the error amplifier (EA) for comparison, which in turn generates an output voltage ($V_{ERR}$). In the ramp generator (RAMP GEN), the emitter of the BJT is coupled to VIN, while the base is coupled to the output of error amplifier EA. The collector of the BJT is arranged to couples a current ($I_{RAMP}$) to the capacitor circuit ($C_R$) to generate a ramp voltage ($V_{RAMP}$).

The error amplifier varies signal $V_{ERR}$ in response to the difference between $V_{REF}$ and $V_{SNS}$. As described previously, $V_{SNS}$ is varies in response to the sensed output current ($I_{OUT}$) via the resistance of transistor $M_{SNS}$. The resulting signal $V_{ERR}$ is thus responsive to changes in the output current ($I_{OUT}$). Since the current source (CS) in the ramp generator circuit (RAMP GEN) is responsive to signal $V_{ERR}$, the ramp rate is also responsive to changes in the output current ($I_{OUT}$). Moreover, since the current source is illustrated as a BJT with an emitter that is coupled to $V_{IN}$, changes in the input voltage ($V_{IN}$) are also reflected in the ramp rate. An optional resistor circuit (not shown) can be placed between the emitter of the BJT and the input voltage ($V_{IN}$) to provide current limiting and emitter degeneration as may be desired.

FIG. 8 is an illustration of still another example closed-loop boost circuit (800). FIG. 8 is similar to FIGS. 6 and 7 and like circuit blocks are similarly labeled.

The current source in the ramp circuit ($CS_{RAMP}$) is illustrated as a field effect transistor (FET) as shown. The load is coupled to a circuit ground through a transistor switch circuit ($T_{SW1}$). The reference generator is replaced with a current source ($CS_{REF}$) that is series coupled to another transistor switch circuit ($T_{SW2}$). The output of the feed-forward circuit (FFCKT) and a startup circuit (STARTUP) are combined with an OR-type logic gate (OR1) that has an output coupled to the latch circuit. Another OR-type logic circuit (OR2) is arranged to evaluate the output voltage (VOUT) and the switch voltage (VSW) to activate an over-voltage protection (OVP) circuit. Yet another OR-type logic circuit (OR3) is arranged to combine the output ($V_{COMP}$) of the comparator circuit (COMP) with the output of the OVP circuit ($V_{OVDET}$). The output of OR3 is coupled to the other side of the latch circuit (LATCH).

The transistor switch circuits ($T_{SW1}$ and $T_{SW2}$) illustrate the finite resistance of the transistors as $R_{SW}$ in series with an ideal switch (SW). The current sources $CS_{REF}$ and $CS_{RAMP}$ are depicted as FET devices, but may be replaced with BJT devices, as well as others.

The operation of circuit 800 is substantially the same as circuit 700 from FIG. 7. Additional over-voltage protection and current limit protection are provided such that excessive conditions in the output voltage ($V_{OUT}$) voltage and current through transistor switching circuit ($P_{SW}$) can be detected such that the transistor switching circuit ($P_{SW}$) will be disabled via the latch circuit. The startup circuit is also depicted to illustrate that the startup circuit need not be directly coupled to the transistor switching circuit (PSW) and can instead be coupled to the latch circuit.

Figure 9:
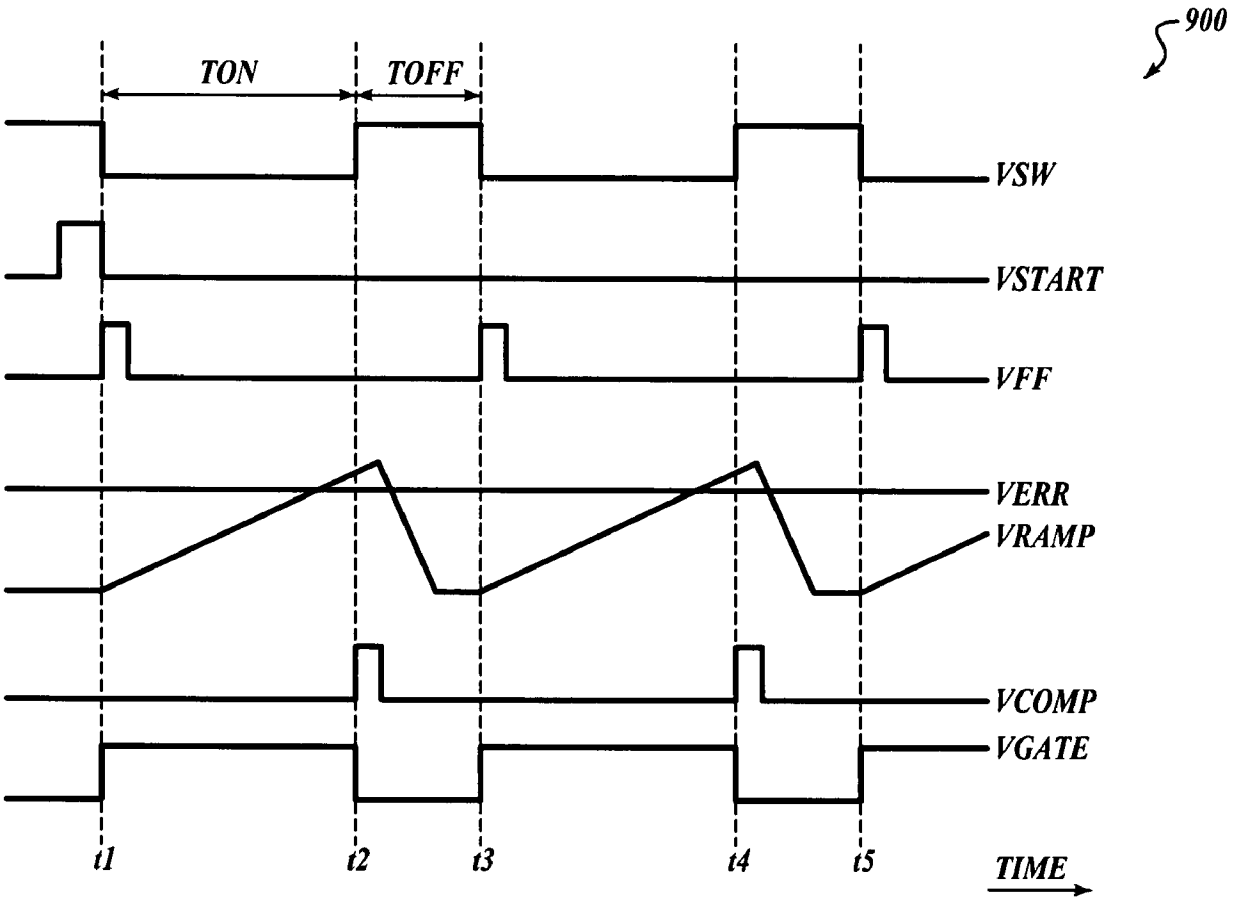
FIG. 9 is an illustration of example signal waveforms for a closed-loop boost circuit.

FIG. 9 is an illustration of example signal waveforms (900) for a closed-loop boost circuit. Waveforms 900 are substantially similar to waveforms 300 from FIG. 3, with the addition of the error signal ($V_{ERR}$). The error signal ($V_{ERR}$) operates as a threshold for the ramp signal ($V_{RAMP}$) to identify the end of the charging cycle for the inductor (L) at time t2.

Figure 10:
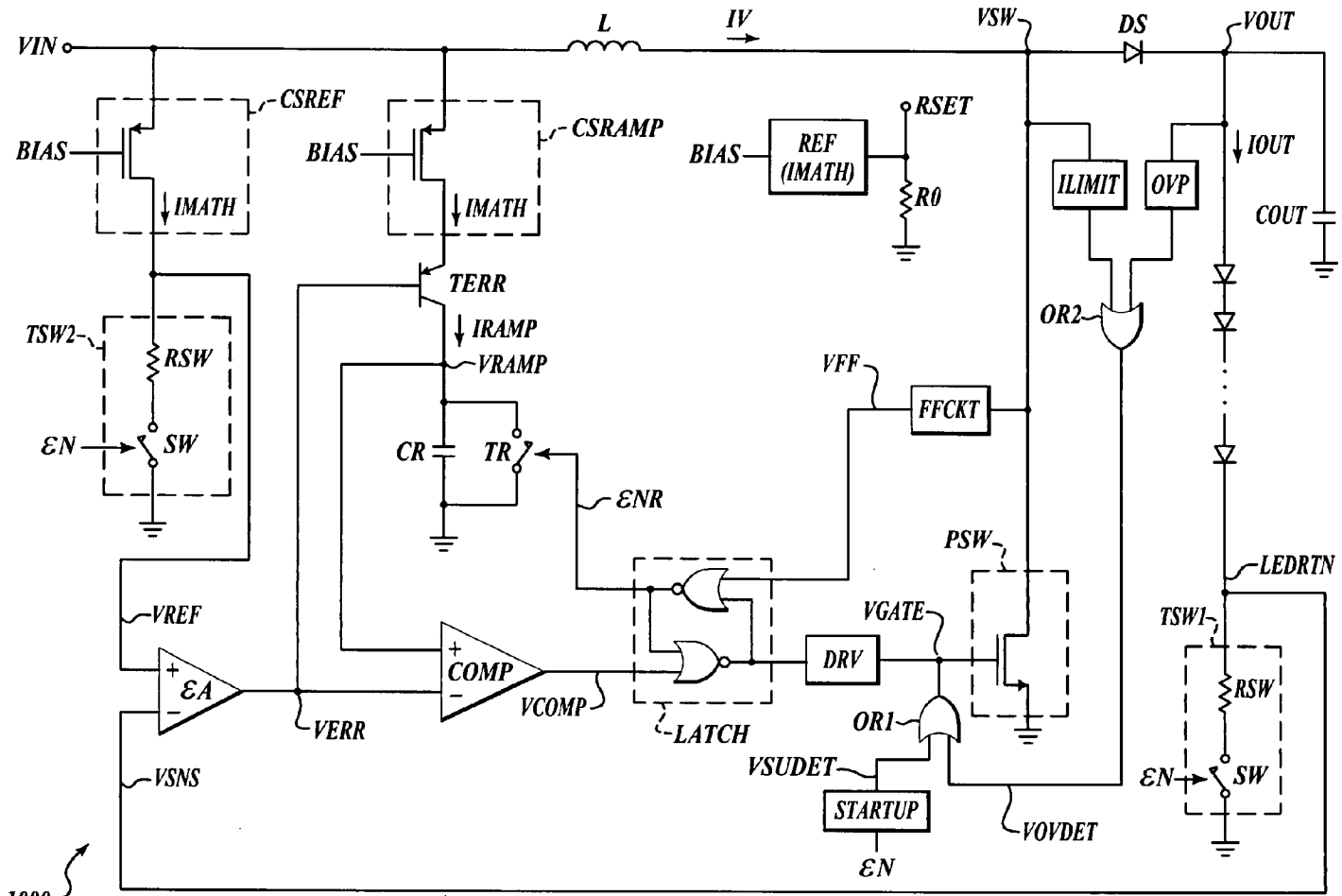
FIG. 10 is an illustration of yet another example closed-loop boost circuit.

FIG. 10 is an illustration of yet another example closed-loop boost circuit (1000) that is arranged similar to the circuit depicted in FIGS. 6–8, with like circuit blocks labeled similarly. Moreover, circuit 1000 includes the mathematically calculated current sources that are similar to that described in FIG. 2. The closed-loop boost circuit (1000) includes: a capacitor ($C_{OUT}$), an inductor (L), an LED circuit ($D_1$, $D_2$, . . . , $D_N$), a Schottky-type diode ($D_S$), a feed-forward circuit (FFCKT), a latch circuit (LATCH), a ramp generator circuit (RAMPGEN), a resistor ($R_0$), a comparator (COMP), an error amplifier (EA), a reference generator circuit (REF IMATH), a voltage reference circuit, three transistor switch circuits ($T_{SW1}$, $T_{SW2}$ and $P_{SW}$), a driver circuit (DRV), a start-up circuit (STARTUP), an over-voltage protection circuit (OVP), and a logic circuit (OR1).

Resistor $R_0$ is coupled between RSET and ground. RAMPGEN is arranged to provide a ramp voltage ($V_{RAMP}$) with a controlled slope when enabled. REF IMATH is arranged to provide a bias voltage (BIAS) that is responsive to the value associated with $R_{SET}$. The voltage reference circuit is arranged to provide a voltage reference ($V_{REF}$). Inductor L is selectively coupled to ground through transistor switch circuit $P_{SW}$ when transistor switch circuit $P_{SW}$ is active, and coupled to the LED circuit through Schottky diode $D_S$ when transistor switch circuit $P_{SW}$ is inactive. The LED circuit is coupled between Schottky diode $D_S$ and ground via transistor switch circuit $T_{SW1}$, when enabled via signal EN. Capacitor $C_{OUT}$ is coupled in parallel with the LED circuit to minimize ripple in the output voltage ($V_{OUT}$).

Feed-forward circuit FFCKT is arranged to sense the voltage ($V_{SW}$) associated with the non-input side of inductor L and provides a signal to an input of latch circuit LATCH. Comparator COMP is arranged to compare ramp voltage $V_{RAMP}$ to error voltage ($V_{ERR}$) and provide a comparison signal ($V_{COMP}$) to another input of latch circuit LATCH. One output of latch circuit LATCH is arranged to provide signal ENR. Another output of latch circuit LATCH is arranged to selectively activate transistor switch circuit $P_{SW}$ via driver circuit DRV and signal $V_{GATE}$.

Transistor switch circuits $T_{SW1}$ and $T_{SW2}$ are similar to those described with respect to FIG. 8. The voltage reference circuit for FIG. 10 is also similar to that described previously for FIG. 8, except that current source $CS_{REF}$ is arranged to provide a current that corresponds to $I_{MATH}$. The resulting reference voltage $V_{REF}$ is given by $V_{REF}=I_{MATH}*R_{SW}$.

The ramp generator circuit comprises a current source circuit ($CS_{RAMP}$) that is series coupled to a capacitor ($C_R$) via a transistor circuit ($T_{ERR}$). The capacitor (CR) is discharged to ground via transistor $T_R$ in response to signal ENR. $CS_{RAMP}$ is illustrated as a biased transistor that provides an output current corresponding to $I_{MATH}$. $T_{ERR}$ is illustrated as a transistor circuit that is controlled by signal $V_{ERR}$ to provide a ramp current ($I_{RAMP}$). The ramp current has a maximum value of $I_{MATH}$, but can be adjusted lower in response to $V_{ERR}$.

The start-up circuit (START UP) is arranged to force signal $V_{GATE}$ through logic circuit OR1 during a start-up sequence (when EN is active) such that inductor L is charged and the latch is initialized to an appropriate condition via comparator COMP and the feed-forward circuit. OVP and $I_{LIMIT}$ circuits are arranged to disable the transistor switch circuit ($P_{SW}$) via logic circuit OR1 when either an over-voltage condition or a current limit is detected from $V_{OUT}$ and $V_{SW}$.

Figure 11A:
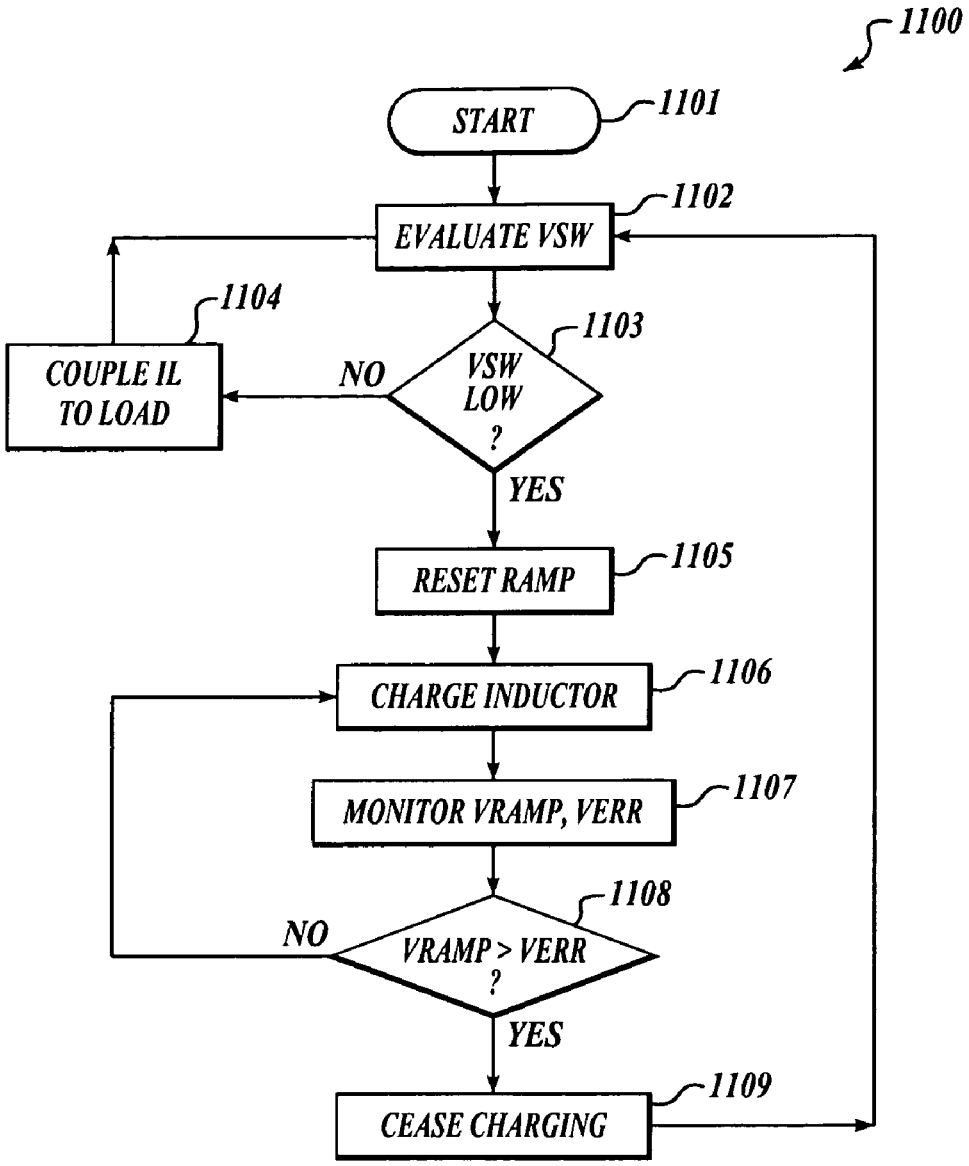
FIG. 11A is an illustration of an example procedural flow for a closed-loop boost circuit.

FIG. 11A is an illustration of an example procedural flow (1100) for a closed-loop boost circuit. Processing begins at block 1101, and proceeds to block 1102 where the switch voltage ($V_{SW}$) is evaluated. Processing continues from block 1103 to block 1104 when VSW is evaluated as a high level. At block 1104 the current in the inductor ($I_L$) is coupled to the load (e.g., the LED circuit). Processing continues from block 1104 to block 1102 where further monitoring is conducted.

Processing flows from block 1103 to block 1105 when VSW is evaluated as a low level. At block 1105, the ramp is reset. Continuing to block 1106, the inductor is charged (e.g., via a transistor switch circuit $P_{SW}$). Proceeding to block 1107, the ramp signal ($V_{RAMP}$) and the error signal ($V_{ERR}$) are monitored. Processing continues from decision block 1108 back to block 1106 when $V_{RAMP}$ does not exceed $V_{ERR}$, such that the inductor continues to charge. Alternatively, processing flows from block 1108 to block 1109 when $V_{RAMP}>V_{ERR}$, where the charging of the inductor is terminated. Processing continues from block 1109 to block 1102.

Figure 11B:
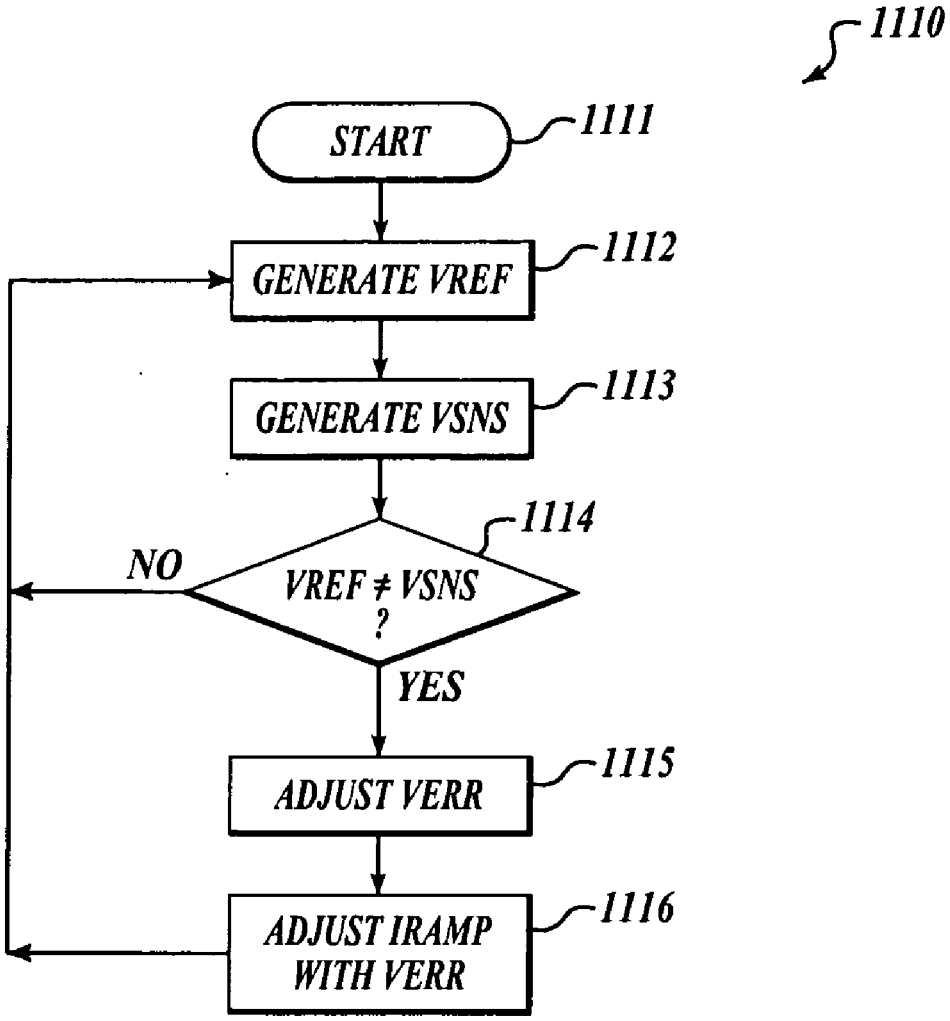
FIG. 11B is an illustration of another example procedural flow for a closed-loop boost circuit, arranged in accordance with the present disclosure.

FIG. 11B is an illustration of another example procedural flow (1110) for a closed-loop boost circuit. Processing begins at block 1111 and continues to block 1112, where the reference signal ($V_{REF}$) is generated. In one example, the reference signal is generated by a band-gap circuit. In another example, the reference signal is generated by a current source and a series resistance. In still another example the reference signal is proportional to $I_{MATH}$.

Proceeding to block 1113, the sense signal ($V_{SNS}$) is generated by sensing the output current ($I_{OUT}$) to the load (e.g., the LED circuit). At decision block 1114, the reference signal ($V_{REF}$) and the sense signal ($V_{SNS}$) are compared. Processing continues to block 1112 when $V_{REF}$ and $V_{SNS}$ are substantially the same. Alternatively, processing continues to block 1115 when $V_{REF}$ and $V_{SNS}$ are substantially the same.

At block 1115, signal $V_{ERR}$ is adjusted based on the difference between $V_{REF}$ and $V_{SNS}$. Processing continues from block 115 to block 1116, where the ramp current ($I_{RAMP}$) is adjusted in response to signal $V_{ERR}$. In one example, $I_{RAMP}$ is linearly related to $V_{ERR}$. In another example, $I_{RAMP}$ is non-linearly related to $V_{ERR}$. In still another example, $I_{RAMP}$ has a maximum value that corresponds to $I_{MATH}$.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An apparatus for closed-loop control of an output current ($I_{OUT}$) that is delivered to a load circuit from an inductor, the apparatus comprising:

a transistor switching circuit that is arranged to selectively couple a switch node to a power supply when activated, such that the inductor is charged by an input voltage ($V_{IN}$) when the transistor switching circuit is activated, wherein the inductor is arranged to deliver the output current ($I_{OUT}$) to the load circuit when the transistor switching circuit is deactivated;

a sense circuit that is arranged to provide a sense signal ($V_{SNS}$) in response to the output current ($I_{OUT}$);

an error amplifier circuit that is arranged to provide an error signal ($V_{ERR}$) in response to a comparison between the sense signal ($V_{SNS}$) and a reference signal ($V_{REF}$);

a ramp generator circuit that is arranged to provide a ramp signal ($V_{RAMP}$), wherein the ramp signal ($V_{RAMP}$) is reset to a predetermined level in response to a reset signal (ENR), and wherein a magnitude associated with the ramp signal ($V_{RAMP}$) is determined by an error signal ($V_{ERR}$);

a comparator circuit that is arranged to compare the ramp signal ($V_{RAMP}$) to the error signal ($V_{ERR}$) to provide a comparison signal ($V_{COMP}$), wherein the comparison signal ($V_{COMP}$) is asserted when the ramp signal ($V_{RAMP}$) exceeds the reference signal ($V_{ERR}$);

a feed-forward circuit that is arranged to activate a pulse signal ($V_{FF}$) when a voltage ($V_{SW}$) associated with the switch node decreases by a predetermined amount; and a latch circuit that is arranged to: assert the reset signal (ENR) when the pulse signal ($V_{FF}$) is asserted, activate the transistor switching circuit when the reset signal (ENR) and the comparison signal ($V_{COMP}$) are de-asserted, and deactivate the transistor switching circuit when the comparison signal ($V_{COMP}$) is asserted.

2. The apparatus of claim 1, wherein the power supply corresponds to at least one of a high power supply, a low power supply, and a circuit ground.

3. The apparatus of claim 1, further comprising at least one of a start-up circuit, an over-voltage protection circuit, and a current limit protection circuit that is arranged to override control of the inductor charging.

4. The apparatus of claim 1, wherein the ramp generator comprises a current source that is arranged to adjust a slope associated with the ramp signal ($V_{RAMP}$) in response to a change in at least one of: the input voltage ($V_{IN}$), the error signal ($V_{ERR}$), and a level that is associated with $I_{MATH}$.

5. The apparatus of claim 1, wherein the ramp generator circuit is further arranged such that a slope associated with the ramp signal ($V_{RAMP}$) is determined by an adjustable parameter (X) and the input voltage ($V_{IN}$) such that the slope is proportional to $X*V_{IN}^2$.

6. The apparatus of claim 1, wherein the transistor switching circuit is further arranged such that the output current ($I_{OUT}$) that is delivered to the load circuit is inversely proportional to $L*V_{OUT}$, where L corresponds to a value associated with the inductor and $V_{OUT}$ corresponds to an output voltage that is associated with the load circuit.

7. The apparatus of claim 1, further comprising: a resistor that is arranged to cooperate with the ramp generator circuit such that a value ($R_{LIM}$) associated with the resistor adjusts a maximum level associated with the slope of the ramp signal ($V_{RAMP}$), wherein the ramp generator circuit, the comparator circuit, the error amplifier circuit, and the feed-forward circuit are arranged such that an on-time ($T_{ON}$) associated with the transistor switching circuit is adjusted by changing the slope of the ramp signal.

8. The apparatus of claim 1, wherein the ramp generator circuit comprises a capacitor ($C_R$) that is charged by a current source ($C_{SRAMP}$) when the reset signal is de-asserted, wherein the current source ($C_{SRAMP}$) is biased by the error signal ($V_{ERR}$).

9. The apparatus of claim 1, wherein the ramp generator circuit comprises a capacitor ($C_R$) that is coupled to a current source ($CS_{RAMP}$) via a transistor circuit ($T_{ERR}$) when the reset signal is de-asserted, wherein the transistor circuit ($T_{ERR}$) is responsive to the error signal ($V_{ERR}$), and wherein the current source ($CS_{RAMP}$) is arranged to limit the ramp current.

10. The apparatus of claim 9, further comprising a resistor that is arranged to cooperate with the ramp generator circuit such that a current level ($I_{MATH}$) associated with the current source ($CS_{RAMP}$) is responsive to a value ($R_{SET}$) associated with the resistor.

11. The apparatus of claim 9, further comprising a resistor that is arranged to cooperate with the ramp generator circuit such that a current level ($I_{MATH}$) associated with the current source ($CS_{RAMP}$) is proportional to $R_{SET}*V_{IN}^2$, wherein the resistor has a value corresponding to $R_{SET}$.

12. The apparatus of claim 1, wherein the ramp generator circuit comprises a bipolar junction transistor (BJT) that is arranged to provide a ramp current ($I_{RAMP}$) to a capacitor circuit ($C_R$) when the reset signal is de-asserted such that the capacitor circuit ($C_R$) generates the ramp signal ($V_{RAMP}$), wherein the BJT is responsive to the error signal ($V_{ERR}$) such that that ramp current ($I_{RAMP}$) varies in response to changes in the output current ($I_{OUT}$).

13. The apparatus of claim 1, further comprising a reference circuit that is arranged to provide the reference signal ($V_{REF}$) proportional to a level associated with $I_{MATH}$.

14. The apparatus of claim 1, further comprising a temperature compensated reference circuit that is arrange to provide the reference signal ($V_{REF}$).

15. An apparatus for closed-loop control of an output current ($I_{OUT}$) that is delivered to a load circuit from an inductor, the apparatus comprising:

a switching means that is arranged to selectively couple a switch node to a power supply node when activated, such that the inductor is charged by an input voltage ($V_{IN}$) when the switching means is activated, wherein the inductor is arranged to deliver the output current ($I_{OUT}$) to the load circuit when the switching means is deactivated;

an output sense means that is arranged to provide a sense signal ($V_{SNS}$) that is proportional to the output current ($I_{OUT}$);

a difference means that is arranged to adjust an error signal ($V_{ERR}$) in response to a difference between the sense signal ($V_{SNS}$) and a reference signal ($V_{REF}$);

a ramp means that is arranged to provide a ramp signal ($V_{RAMP}$), wherein the ramp means is arranged to initialize the ramp signal ($V_{RAMP}$) to a predetermined level in response to a reset signal (ENR);

an adjustment means that is arranged to adjust a slope of the ramp signal (VRAMP) in response to the error signal ($V_{ERR}$);

a comparison means that is arranged to compare the ramp signal ($V_{RAMP}$) to the error signal ($V_{ERR}$) to provide a comparison signal ($V_{COMP}$), wherein the comparison signal ($V_{COMP}$) is asserted when the ramp signal ($V_{RAMP}$) reaches the reference signal ($V_{ERR}$);

a discharge sense means that is arranged to activate a pulse signal ($V_{FF}$) when the voltage ($V_{SW}$) associated with the switch node is sensed as decreasing by a predetermined amount; and a latch means that is arranged to: assert the reset signal (ENR) when the pulse signal ($V_{FF}$) is asserted, activate the switching means when the reset signal (ENR) and the comparison signal ($V_{COMP}$) are de-asserted, and deactivate the switching means when the comparison signal ($V_{COMP}$) is asserted.

16. The apparatus of claim 15, wherein the ramp means is further arranged such that a limit associated with slope of the ramp signal ($V_{RAMP}$) is determined by at least one of: a resistor value (RLIM), the input voltage ($V_{IN}$), a current source ($CS_{RAMP}$), and an adjustable parameter (X).

17. The apparatus of claim 15, wherein the ramp means is arranged such that the ramp signal ($V_{RAMP}$) is a decreasing signal and the predetermined level corresponds to a high power supply level.

18. The apparatus of claim 15, wherein the ramp means is arranged such that the ramp signal ($V_{RAMP}$) is an increasing signal and the predetermined level corresponds to a low power supply level.

19. A method for providing closed-loop control of an output current ($I_{OUT}$) to a load circuit from an inductor (L), the method comprising:

evaluating a switch signal ($V_{SW}$), wherein the switch signal is associated with the inductor (L);

resetting a ramp signal ($V_{RAMP}$) to a reset level when the switch signal ($V_{SW}$) drops below a predetermined level, wherein the ramp signal ($V_{RAMP}$) has a characteristic slope;

generating an error signal ($V_{ERR}$) that is responsive to changes in the output current ($I_{OUT}$);

adjusting the characteristic slope of the ramp signal ($V_{RAMP}$) in response to the error signal ($V_{ERR}$);

comparing the ramp signal ($V_{RAMP}$) and the error signal ($V_{ERR}$);

controlling an on-time interval in response to the ramp signal ($V_{RAMP}$) and the error signal ($V_{ERR}$), wherein the on-time interval is related to the characteristic slope of the ramp signal ($V_{RAMP}$);

charging the inductor with an input voltage ($V_{IN}$) over the on-time interval ($T_{ON}$); and coupling current from the inductor to the load circuit when a ramp signal level has reached the error signal level and the switch signal ($V_{SW}$) is above the predetermined level.

20. The method of claim 19, further comprising: adjusting the characteristic slope of the ramp signal ($V_{RAMP}$) in response to at least one of: the input voltage ($V_{IN}$), a resistive based current limit, a current source based current limit, and a mathematically derived current limit ($I_{MATH}$).

* * * * *

UNITED STATES PATENT AND TRADEMARK OFFICE

CERTIFICATE OF CORRECTION

PATENT NO. : 7,071,630 B1 
APPLICATION NO. : 11/211132
DATED : July 4, 2006
INVENTOR(S) : Truc Linh York It is certified that error appears in the above-identified patent and that said Letters Patent is hereby corrected as shown below:

Column 5, Line 15: "(e.g., $V_{RAMP}$=0V)" should read --(e.g., $V_{RAMP}$ = 0V)--

Column 9, Line 17: "Freq = $(V_{OUT} - V_{IN}) / (V_{OUT-}*T_{ON})$ (Eq. 16)" should read --Freq = $(V_{OUT} - V_{IN}) / (V_{OUT}*T_{ON})$ (Eq. 16)--

Column 13, Line 53: "circuit that is arrange" should read --circuit that is arranged--

Signed and Sealed this

Twenty-eighth Day of November, 2006

JON W. DUDAS
*Director of the United States Patent and Trademark Office*